US012449240B2

(12) United States Patent
Alqahtani

(10) Patent No.: US 12,449,240 B2
(45) Date of Patent: Oct. 21, 2025

(54) BULLET COMPRISING INLET AND OUTLET CHANNELS

(71) Applicant: Ali Mohi Saeed Alqahtani, Khamis Mushait (SA)

(72) Inventor: Ali Mohi Saeed Alqahtani, Khamis Mushait (SA)

( * ) Notice: Subject to any disclaimer, the term of this patent is extended or adjusted under 35 U.S.C. 154(b) by 0 days.

(21) Appl. No.: 18/602,725

(22) Filed: Mar. 12, 2024

(65) Prior Publication Data

US 2025/0283703 A1 Sep. 11, 2025

Related U.S. Application Data

(63) Continuation-in-part of application No. 29/931,638, filed on Mar. 7, 2024, now Pat. No. Des. 1,060,591.

(51) Int. Cl.
*F42B 10/02* (2006.01)

(52) U.S. Cl.
CPC ..... *F42B 10/02* (2013.01)

(58) Field of Classification Search
CPC ..... F42B 10/02
USPC ..... 102/501
See application file for complete search history.

(56) References Cited

U.S. PATENT DOCUMENTS

| | | | | |
|---|---|---|---|---|
| 4,945,836 A * | 8/1990 | Michaels | ..... | F42B 10/34 102/517 |
| 2016/0169644 A1* | 6/2016 | Ziegler | ..... | F42B 10/38 244/3.23 |

FOREIGN PATENT DOCUMENTS

| | | | | |
|---|---|---|---|---|
| CA | 2589300 A1 * | 11/2008 | ..... | F42B 10/34 |
| DE | 202005011174 U1 * | 11/2005 | ..... | F41A 21/16 |
| GB | 1351666 A * | 5/1974 | ..... | F42B 10/54 |
| GB | 2422419 A * | 7/2006 | ..... | F42B 10/34 |
| KR | 20200070011 A * | 6/2020 | ..... | F42B 10/34 |
| KR | 2730826 B1 * | 11/2024 | ..... | F16C 41/00 |
| WO | WO-2018176157 A2 * | 10/2018 | ..... | F42B 10/38 |
| WO | WO-2023272387 A1 * | 1/2023 | ..... | F42B 10/38 |

* cited by examiner

*Primary Examiner* — Samir Abdosh

(57) ABSTRACT

A bullet having an inlet channel and a plurality of outlet channels wherein, during flight, air enters into the bullet through the inlet channel and is expelled through the outlet channels. The inlet channel traverses from the leading edge of the bullet into a proximal point in the bullet, wherein the inlet channel branches off into the plurality of outlet channels. The outlet channels expel air through the lateral sides of the bullet.

17 Claims, 11 Drawing Sheets

BULLET COMPRISING INLET AND OUTLET CHANNELS

FIELD OF THE INVENTION

The present invention relates generally to a bullet. More specifically, the present invention is a bullet comprising multiple internal airway channels that expel air during trajectory of the bullet.

BACKGROUND OF THE INVENTION

The development and innovation of bullet technology have been a focal point in the evolution of firearms and ammunition. Bullets, the projectile component of firearm ammunition, are designed to be fired from a gun's barrel with the aim of hitting a target accurately and with sufficient force. The design and structure of a bullet play crucial roles in its aerodynamics, stability, range, and accuracy.

Traditionally, bullets have been designed with a focus on achieving a balance between aerodynamic efficiency and impact effectiveness. Most conventional bullets feature a solid nose or a pointed tip, known as the "ogive," which helps to reduce air resistance during flight, thereby increasing the bullet's velocity and range. However, these designs come with inherent limitations, particularly in terms of air flow management around the bullet during its trajectory.

One of the significant challenges with traditional bullet designs is the drag force exerted by air resistance. As the bullet travels through the air, it encounters drag, which slows it down, reducing its range and accuracy over long distances. The drag force is a direct consequence of the bullet's interaction with air molecules, which can also affect the bullet's stability.

Furthermore, conventional bullet designs do not actively utilize the air flow around them to improve performance. The interaction between the bullet and the air through which it travels has been largely seen as an obstacle to be minimized rather than an opportunity to be exploited for enhancing the bullet's flight characteristics.

In response to the limitations of traditional bullet designs, the concept of a bullet with an inlet channel on the nose, extending downward and branching off into a plurality of outlet channels, presents an innovative solution aimed at overcoming these challenges. This design seeks to actively manage the air flow around the bullet in a way that enhances its performance.

The inlet channel serves as an entry point for air as the bullet travels forward. Instead of allowing the air to merely push against the bullet and create drag, this design channels the air through the body of the bullet. The air then exits through the outlet channels, which are strategically positioned to optimize the bullet's aerodynamic properties.

By managing the air flow in this manner, the design aims to reduce the overall drag force on the bullet. This can lead to several performance improvements, including increased velocity, greater stability during flight, and enhanced accuracy over longer distances. Essentially, the bullet uses the air it encounters not as a hindrance but as a means to improve its trajectory and effectiveness.

The innovative design of a bullet with an inlet and outlet channel represents a significant departure from traditional bullet technology. By addressing the limitations associated with air resistance and drag, this invention aims to enhance the performance of bullets, offering potential advancements in accuracy, range, and stability. This approach not only demonstrates a novel way of thinking about bullet design but also opens up new possibilities for the future of ammunition technology, with broad implications for both military and civilian applications.

SUMMARY OF THE INVENTION

A bullet having an inlet channel and a plurality of outlet channels wherein, during flight, air enters into the bullet through the inlet channel and is expelled through the outlet channels. The bullet may possess any number of outlet channels.

DETAIL DESCRIPTIONS OF THE INVENTION

Figure 1:
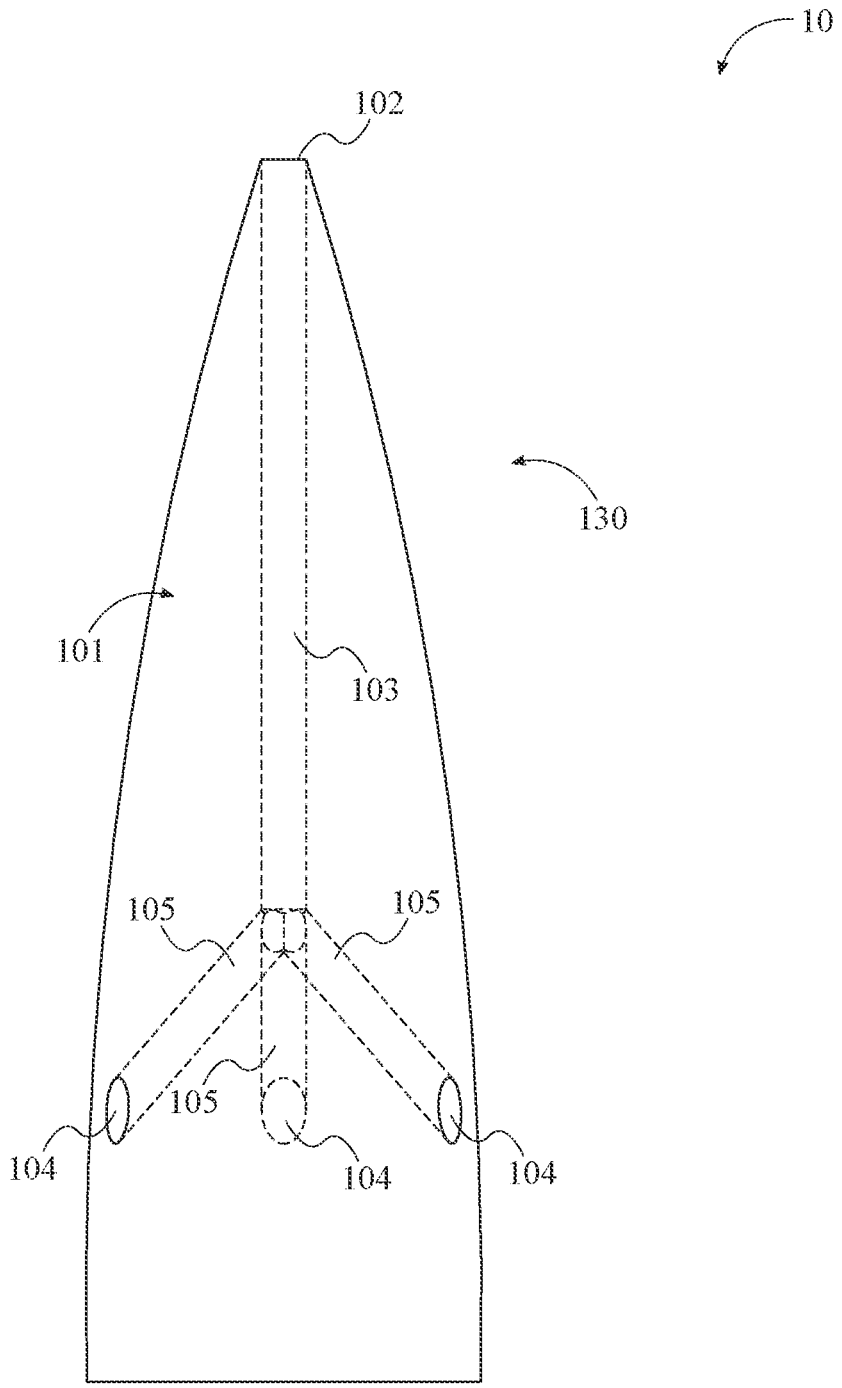
FIG. 1 is a front view of one embodiment of the present invention; said embodiment comprising three outlet channels.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term-differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

The present disclosure includes many aspects and features. Moreover, while many aspects and features relate to, and are described in the context of a bullet comprising inlet and outlet channels, embodiments of the present disclosure are not limited to use only in this context.

The present invention, as shown in FIG. 1 through FIG. 11 is a bullet 10 comprising an inlet channel 103 and a plurality of outlet channels 105. In the preferred embodiment of the present invention, as shown in FIG. 1, the outlet channels 105 are composed of cylindrical holes comprising a distal end and a proximal wherein the proximal end of the outlet channels intersect with each other, and the distal end is the opposite end of each outlet channel extending outwardly. Additionally, as shown in FIG. 1, the inlet channel 103 further comprises a proximal end and a distal end wherein the distal end is the forward most portion of the inlet channel 103, relative to the flight path of motion, and the proximal end of the inlet channel 103 intersects the proximal ends of each of the outlet channels 105, thus providing a free pathway for airflow between the inlet channel 103 and the plurality of outlet channels 105. In the preferred embodiment of the present invention, the inlet 103 and outlet channels 105 are composed of steel.

Figure 2:
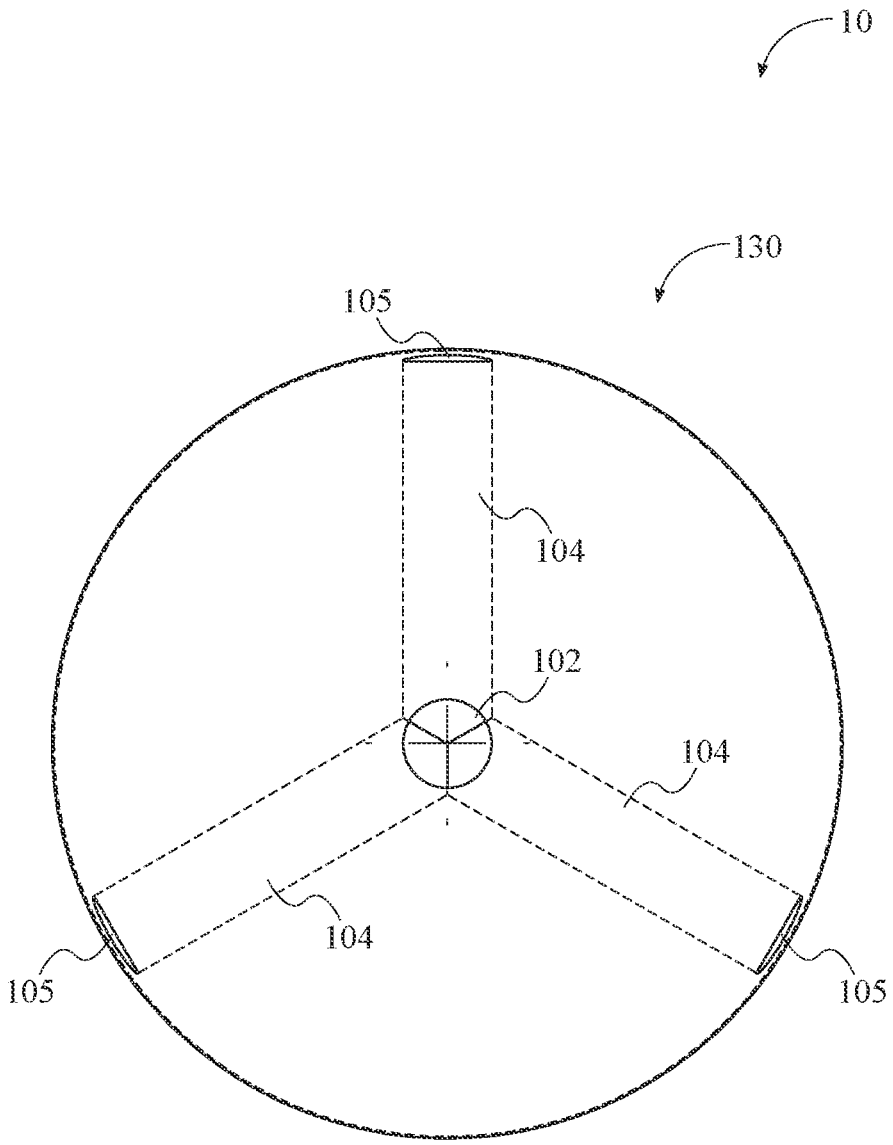
FIG. 2 is a top view of one embodiment of the present invention; said embodiment comprising three outlet channels.

As shown in FIG. 1 and FIG. 2, the distal ends of the inlet channel 103 and each of the outlet channels 105 comprises a port 102, 104. The inlet channel 103 comprises an inlet port 102, whereas each of the outlet channels 105 comprise an outlet port 104. In the context of the present invention, the bullet 10 further comprises an exterior surface 101, wherein the inlet port 102 is an opening in the surface 101 by which air enters into the bullet 10, via the leading edge. Moreover, the leading edge, as within the context of the present invention, is the forward most point of the bullet 10 while traveling its trajectory after firing from the barrel of a firearm. The outlet ports 104, within the context of the present invention, are openings in the surface 101 by which air exits from the bullet 10. As further shown in FIG. 1 and FIG. 2, the plurality of outlet channels 104 are equally spaced about the circumference of the bullet and have a downward angle. In the preferred embodiment of the present invention, the downward angle of the outlet channels 105 is a 45° angle, as shown in FIG. 3.

Figure 3:
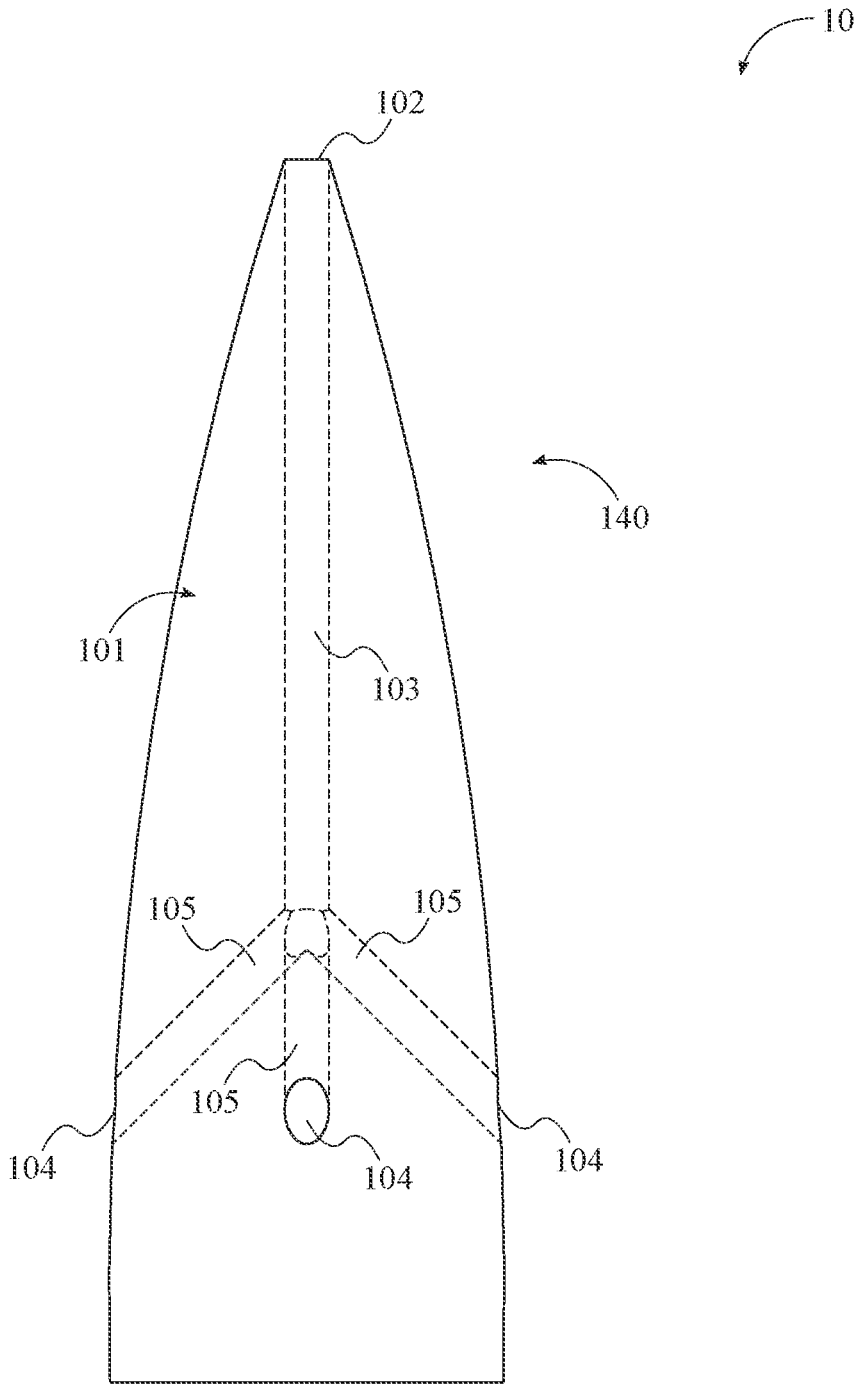
FIG. 3 is a front view of one embodiment of the present invention; said embodiment comprising four outlet channels.
Figure 4:
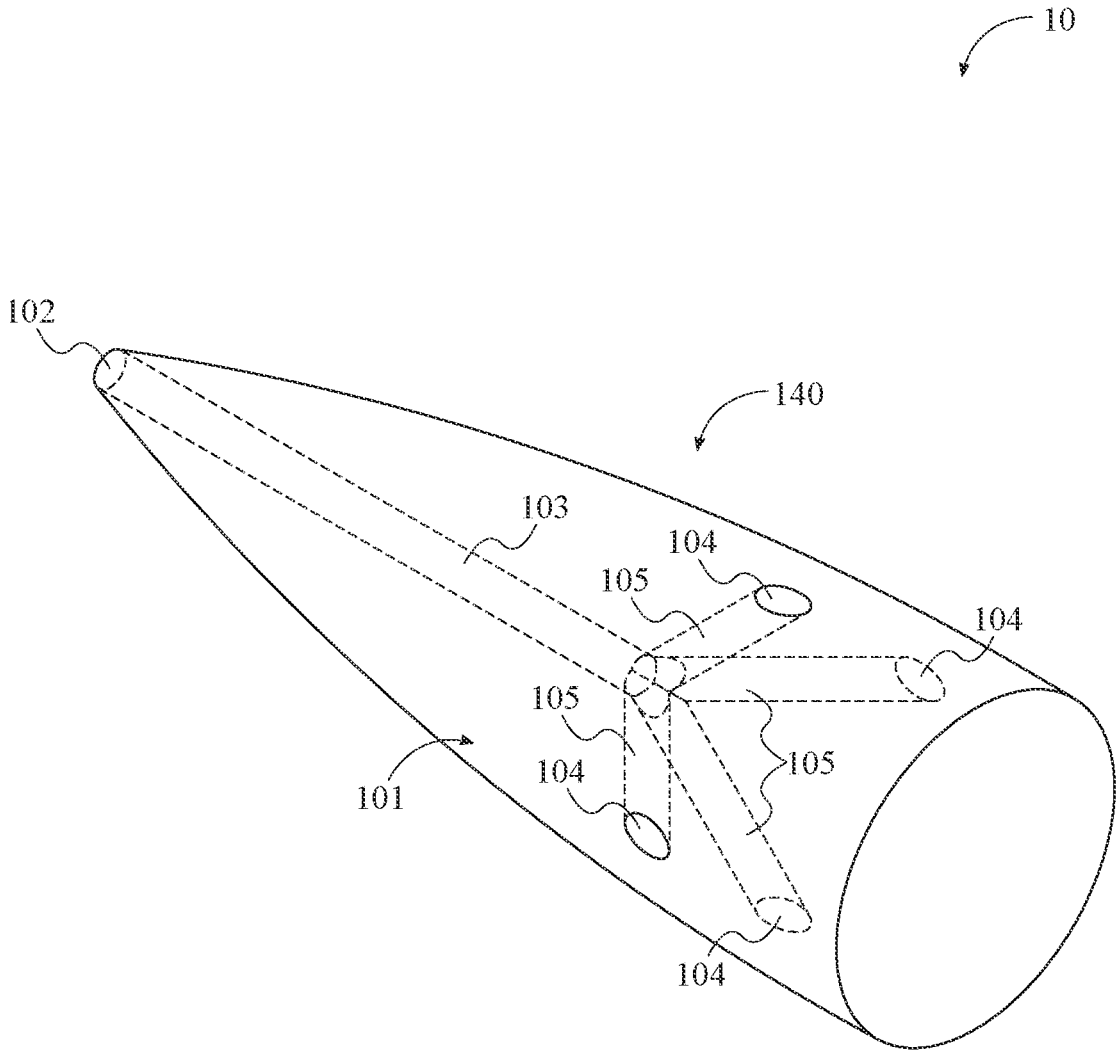
FIG. 4 is a perspective view of one embodiment of the present invention; said embodiment comprising four outlet channels.
Figure 5:
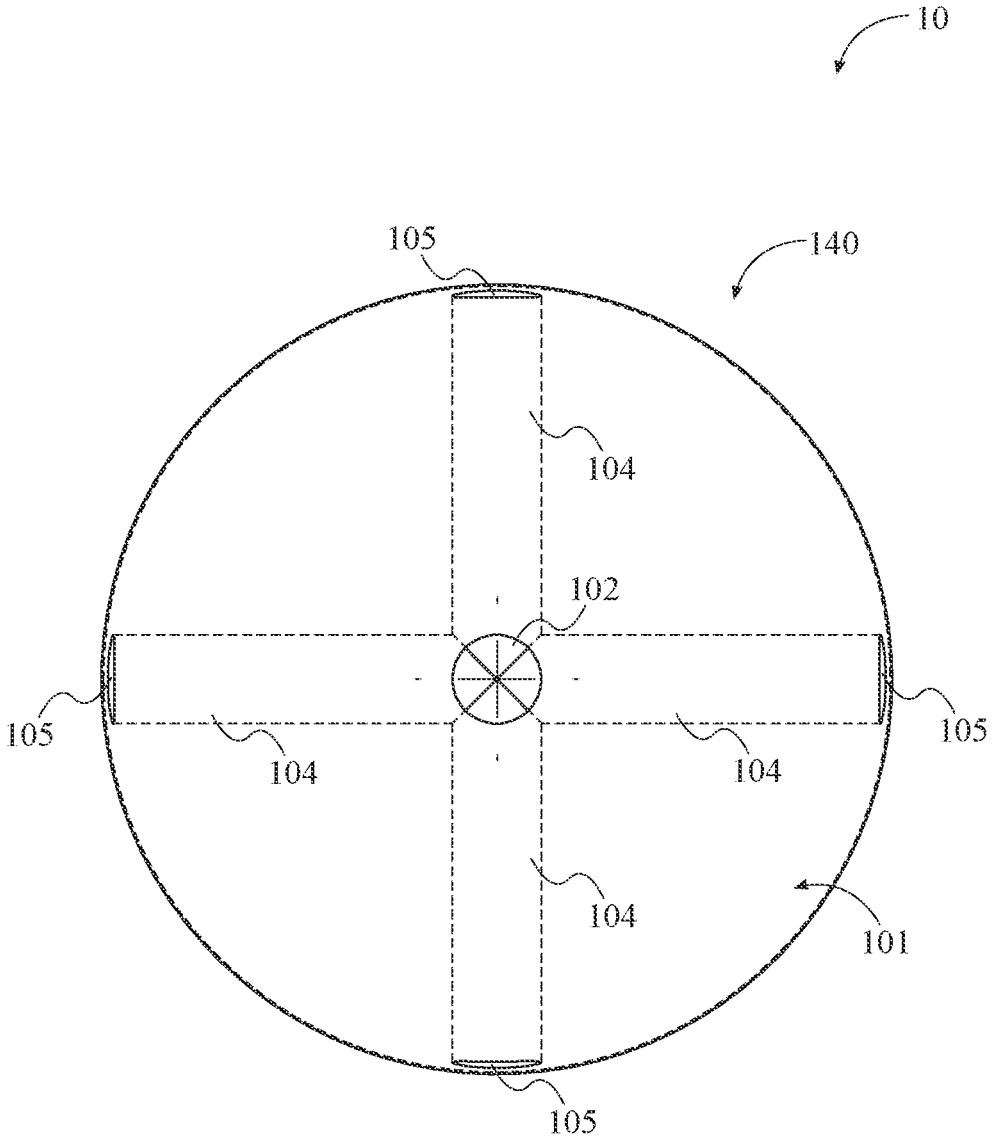
FIG. 5 is a top view of one embodiment of the present invention; said embodiment comprising four outlet channels.
Figure 6:
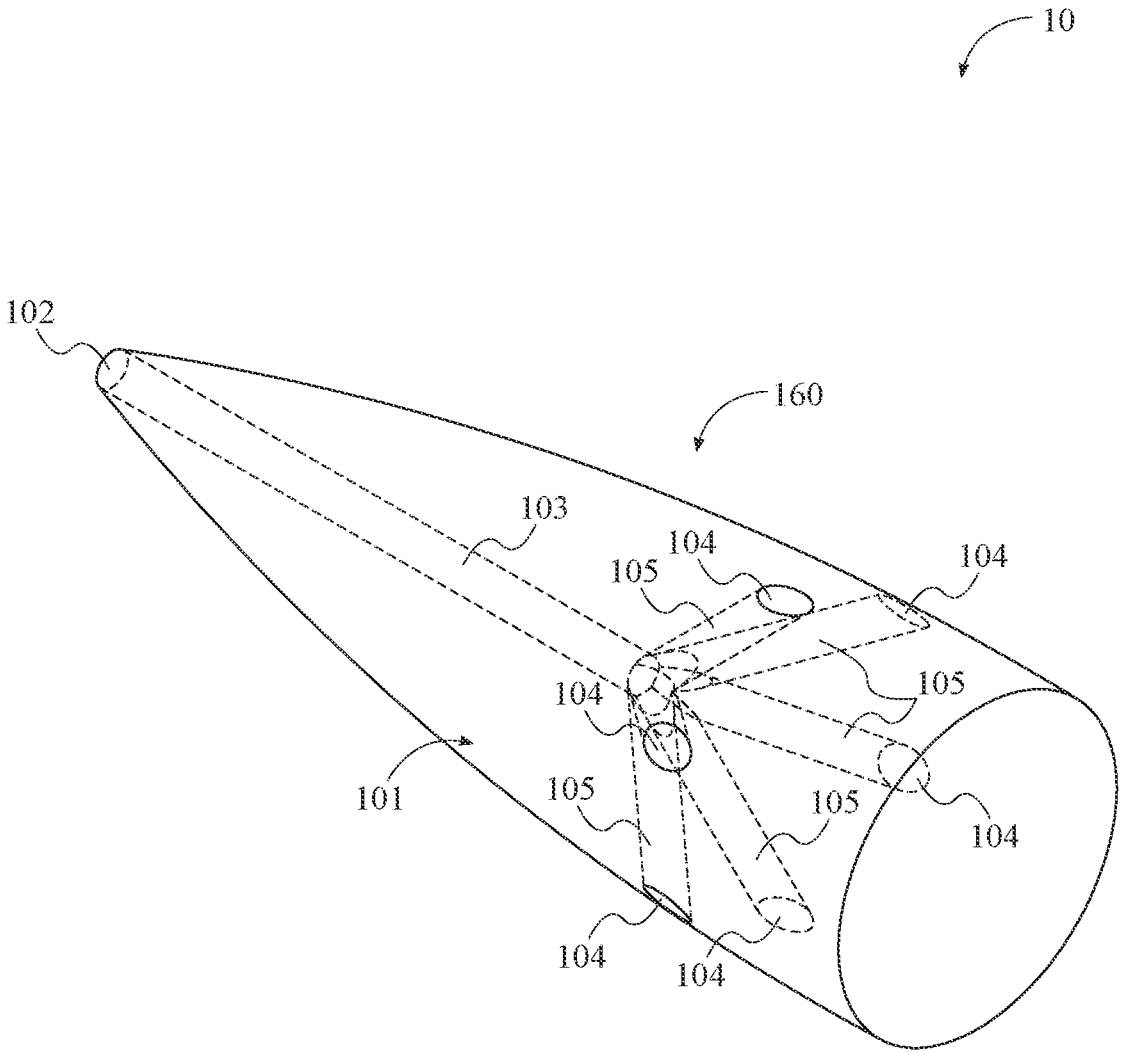
FIG. 6 is a perspective view of one embodiment of the present invention; said embodiment comprising six outlet channels.
Figure 7:
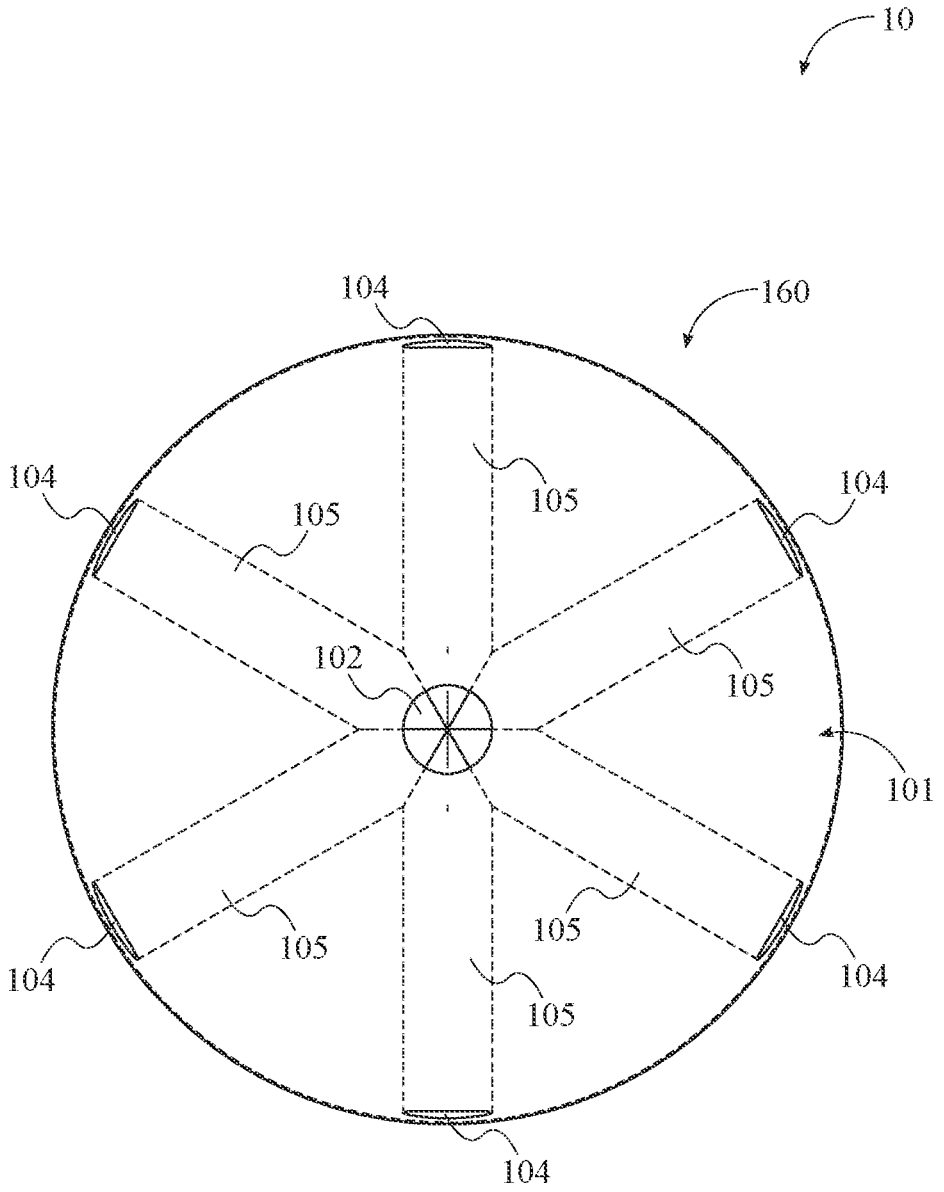
FIG. 7 is a top view of one embodiment of the present invention; said embodiment comprising six outlet channels.

In one embodiment 130 of the present invention, as shown in FIG. 1, FIG. 2, and FIG. 3, the present invention comprises three outlet channels 105, separated by 120° from the adjacent outlet channel, each outlet channel 105 comprising a downward angle of 45°. As shown in FIG. 4 and FIG. 5, in some embodiments 140 of the present invention, the bullet may comprise four outlet channels 105, each extending 90° from the adjacent channel about the circumference of the bullet 10. Furthermore, as shown in FIG. 6 and FIG. 7, in additional alternative embodiments 160, the present invention may comprise six outlet channels 105 extending 60° from the adjacent channel about the circumference of the bullet 10. Within the context of the present invention, although embodiments disclosing three 130, four 140, and six 160 outlet channels have been shown and described, the number of outlet channels is not limited to such.

Figure 8:
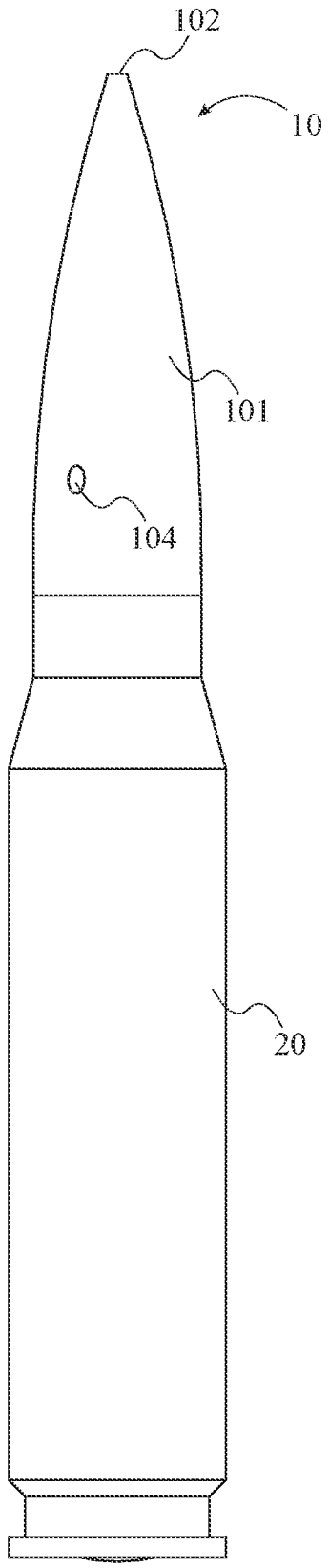
FIG. 8 is a front view of the present invention; wherein the present invention is coupled to a shell casing.
Figure 9:
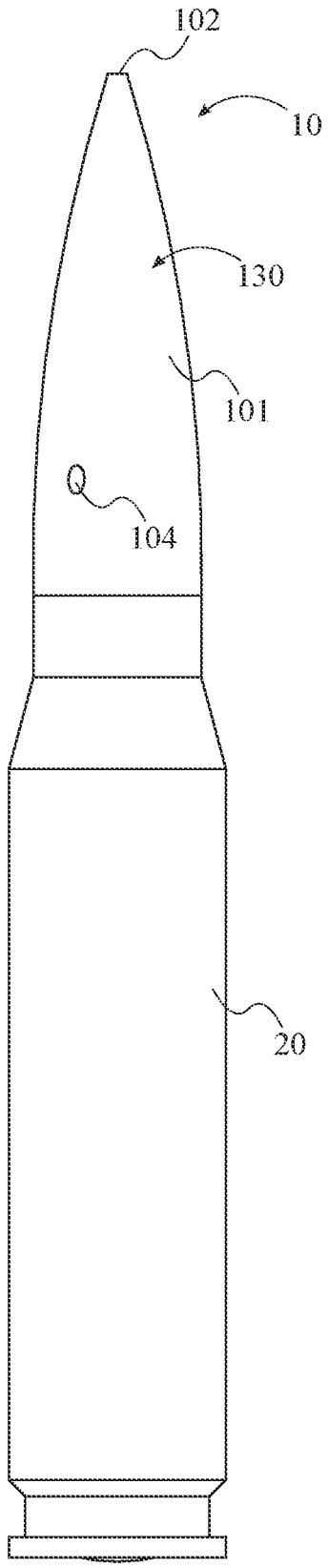
FIG. 9 is a front view of one embodiment of the present invention comprising three outlet channels; wherein the present invention is coupled to a shell casing.
Figure 10:
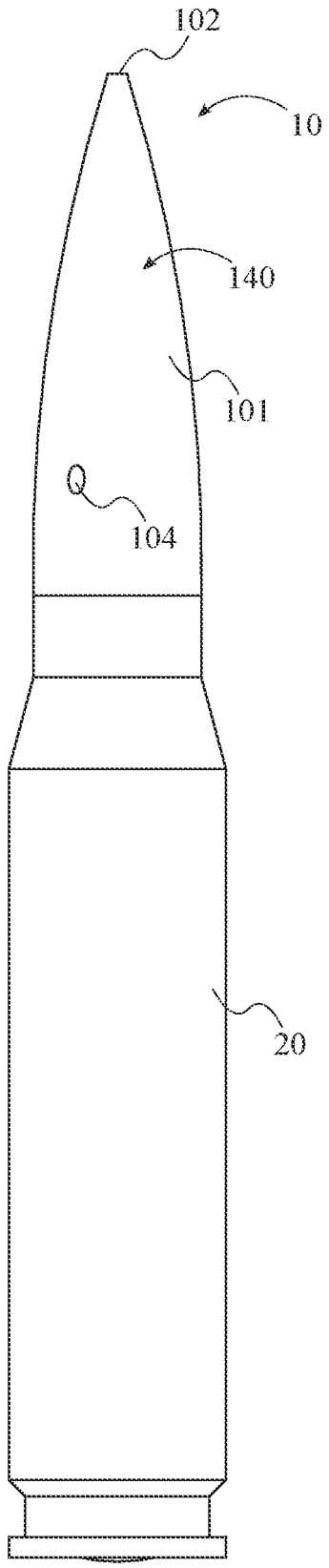
FIG. 10 is a front view of one embodiment of the present invention comprising four outlet channels; wherein the present invention is coupled to a shell casing.
Figure 11:
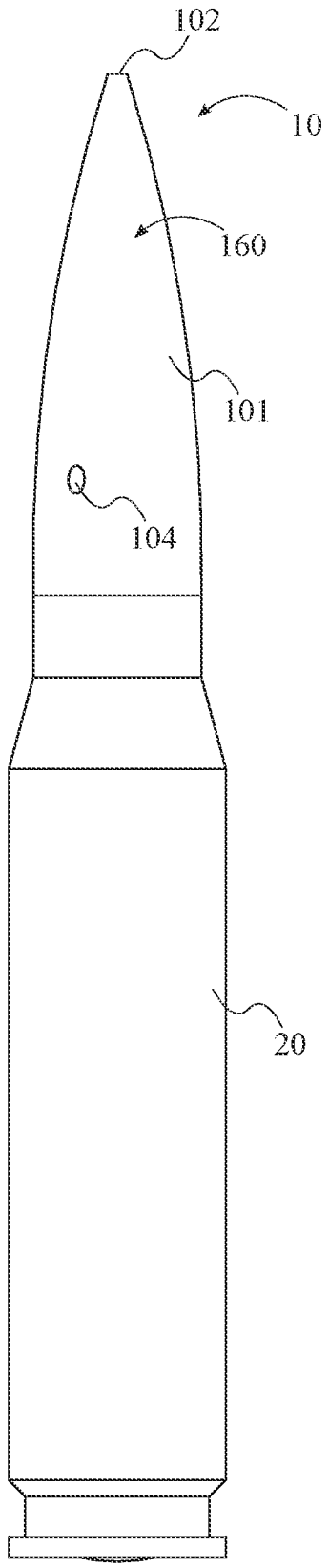
FIG. 11 is a front view of one embodiment of the present invention comprising six outlet channels; wherein the present invention is coupled to a shell casing.

In the preferred embodiment, as shown in FIG. 8, the bullet 10 is coupled to a shell casing 20 prior to being fired. As understood to one of ordinary skill in the art, once the bullet 10 is fired, the bullet is expelled from the shell casing 20. During the flight of the bullet 10, air is expelled from the plurality of outlet channels 105 via the outlet ports 104. In the context of the preferred present invention, regardless of the number of outlet channels 105, the bullet 10 is preferably coupled to a shell casing 20 prior to firing, as shown in FIG. 9, FIG. 10, and FIG. 11.

Although the invention has been explained in relation to its preferred embodiment, it is to be understood that many other possible modifications and variations can be made without departing from the spirit and scope of the invention.

What is claimed is:

1. A bullet comprising a plurality of outlet channels wherein;

each outlet channel extends radially outward at a rearward angle towards a circumferential position on the bullet;

air is expelled outwardly from each of the outlet channels during flight of the bullet; and the outlet channels expel air at a rearward angle relative to the direction of flight.

2. The bullet as claimed in claim 1, further comprising an inlet port wherein air passes through the inlet port during flight.

3. The bullet as claimed in claim 2 further comprising an inlet channel wherein:

the inlet channel, comprising a distal end and a proximal end, traversing from the inlet port to a location within the bullet;

the inlet port located at the distal end of the inlet channel; and the plurality of outlet channels branching radially outwardly from the proximal end of the inlet channel.

4. The bullet as claimed in claim 3 further comprising a plurality of outlet ports wherein each of the outlet channels comprises a proximal end and a distal end;

the proximal end of each outlet channel conjoining at the proximal end of the inlet channel; and the distal end of the outlet channels each comprising an outlet port wherein the air is expelled from the bullet.

5. The bullet as claimed in claim 4 further comprising an exterior surface wherein the exterior surface is the outwardly facing surface of the bullet;

the inlet port and each of the outlet ports being integrated into the exterior surface of the bullet whereby the inlet port and each outlet ports are defined as the plane of intersection between the respective channels and the exterior surface.

6. The bullet as claimed in claim 5 comprising three outlet channels.

7. The bullet as claimed in claim 5 comprising four outlet channels.

8. The bullet as claimed in claim 5 comprising six outlet channels.

9. The bullet as claimed in claim 5 wherein the bullet is coupled to a shell casing.

10. A bullet comprising three outlet channels wherein;

air is expelled outwardly from each of the outlet channels during flight of the bullet; and the outlet channels expel air at a rearward angle relative to the direction of flight;

the three outlet channels traversing outwardly from a central location of the bullet; and each channel separated by a 120° angle from the adjacent channel.

11. The bullet as claimed in claim 10, further comprising an inlet port wherein air passes through the inlet port during flight.

12. The bullet as claimed in claim 11 further comprising an inlet channel wherein:

the inlet channel, comprising a distal end and a proximal end, traversing from the inlet port to a location within the bullet;

the inlet port located at the distal end of the inlet channel; and the plurality of outlet channels branching outwardly from the proximal end of the inlet channel.

13. The bullet as claimed in claim 12 further comprising a plurality of outlet ports wherein each of the outlet channels comprises a proximal end and a distal end;

the proximal end of each outlet channel conjoining at the proximal end of the inlet channel; and the distal end of the outlet channels each comprising an outlet port wherein the air is expelled from the bullet.

14. The bullet as claimed in claim 13 further comprising an exterior surface wherein the exterior surface is the outwardly facing surface of the bullet;

the inlet port and each of the outlet ports being integrated into the exterior surface of the bullet whereby the inlet port and each outlet ports are defined as the plane of intersection between the respective channels and the exterior surface.

15. The bullet as claimed in claim 14 wherein the bullet is coupled to a shell casing.

16. A bullet comprising a plurality of outlet channels wherein;

air is expelled radially outward from each of the outlet channels through a plurality of outlet ports positioned about a circumference of the bullet during flight of said bullet;

the outlet channels expel air at a rearward angle relative to the direction of flight; and the bullet is coupled to a shell casing.

17. The bullet as claimed in claim 16, further comprising:

an inlet port;

an inlet channel;

and an exterior surface;

wherein:

air passes through the inlet port during flight;

the inlet channel, comprising a distal end and a proximal end, traversing from the inlet port to a location within the bullet;

the inlet port located at the distal end of the inlet channel;

the plurality of outlet channels branching outwardly from the proximal end of the inlet channel;

each of the outlet channels comprises a proximal end and a distal end;

the proximal end of each outlet channel conjoining at the proximal end of the inlet channel; and the distal end of the outlet channels each comprising an outlet port wherein the air is expelled from the bullet;

the exterior surface is the outwardly facing surface of the bullet;

the inlet port and each of the outlet ports being integrated into the exterior surface of the bullet whereby the inlet port and each outlet ports are defined as the plane of intersection between the respective channels and the exterior surface.

* * * * *